US005230691A

United States Patent [19]

Monma

[11] Patent Number: 5,230,691

[45] Date of Patent: Jul. 27, 1993

[54] CORRECTION MECHANISM FOR BENT RECORDING SHEET

[75] Inventor: Yoshio Monma, Ooi, Japan

[73] Assignee: Asahi Kogaku Kogyo Kabushiki Kaisha, Tokyo, Japan

[21] Appl. No.: 700,262

[22] Filed: May 15, 1991

[30] Foreign Application Priority Data

May 16, 1990 [JP] Japan ..... 2-125765

[51] Int. Cl.[5] ..... B41F 13/54; B65H 23/34

[52] U.S. Cl. ..... 493/321; 493/459; 162/271

[58] Field of Search ..... 493/320, 321, 459; 162/270, 271

[56] References Cited

U.S. PATENT DOCUMENTS

| | | | |
|---|---|---|---|
| 2,012,953 | 9/1935 | Brunner et al. | 162/271 |
| 3,442,503 | 5/1969 | Call | 493/410 |
| 4,013,284 | 3/1977 | Demetre | 271/183 |
| 4,475,896 | 10/1984 | Bains | 162/271 |
| 4,505,695 | 3/1985 | Billings | 493/459 |
| 4,662,625 | 5/1987 | Hoyer | 271/272 |
| 4,943,270 | 7/1990 | Fleckenstein | 493/459 |
| 4,952,281 | 8/1990 | Akira | 493/459 |

FOREIGN PATENT DOCUMENTS

| | | | |
|---|---|---|---|
| 0197722 | 10/1986 | European Pat. Off. . | |
| 2646281 | 4/1977 | Fed. Rep. of Germany . | |
| 267255 | 10/1989 | Japan | 493/459 |
| 1229907 | 4/1971 | United Kingdom . | |
| 2141112 | 12/1984 | United Kingdom . | |
| 2220923 | 1/1990 | United Kingdom . | |
| 2223040 | 3/1990 | United Kingdom . | |

*Primary Examiner*—William E. Terrell
*Attorney, Agent, or Firm*—Sandler, Greenblum & Bernstein

[57] ABSTRACT

In an electrophotographic image recording apparatus, a bending correction mechanism is provided for correcting a bending direction of a recording sheet such as fan-fold paper which is fed therethrough. In the mechanism, a pressure roller is provided and is arranged on the upstream side of the feed path of the recording sheet with respect to a photoconductive drum of the apparatus, and on the photoconductive drum side with respect to the feed path of the recording sheet. A guide member arranged opposite to the pressure roller with respect to the feed path of the recording sheet is also provided. The recording sheet is nipped between the pressure roller and the guide member, and the recording sheet is caused to contact the circumferential surface of the pressure roller member by a predetermined amount.

16 Claims, 4 Drawing Sheets

CORRECTION MECHANISM FOR BENT RECORDING SHEET

BACKGROUND OF THE INVENTION

The present invention relates to a mechanism to be adapted in an image recording apparatus for correcting a bent recording sheet.

Conventionally, there have been known electrophotographic image recording apparatuses, wherein a latent image is formed by exposing a uniformly charged photoconductive material provided on the circumferential surface of a photoconductive drum, the latent image is developed (toner image is formed) by being adhered with toner, and the toner image is transferred onto a recording sheet and fixed by a fixing unit. One of such image recording apparatuses is an electrophotographic printer such as a laser beam printer which prints image data onto a recording medium. A continuous form recording medium such as a so-called fan-fold paper provided with feed holes and perforated tear lines has been conventionally used in such a printer.

The perforated tear lines are provided at the boundary of each page of the fan-fold paper, and the fan-fold paper can be cut off along the perforated tear line. Before the fan-fold paper is introduced in the printer, it is folded alternately in an opposite direction at the tear lines.

Incidentally, a printer using the continuous recording medium such as the fan-fold paper preferably starts printing from the position of the continuous paper spaced apart from the perforated tear line thereof (i.e., spaced apart from the leading edge of a page) by a predetermined distance, and stops the printing at the position having a predetermined distance to the perforated tear line defined along the trailing edge of the page. In this case, when the printing operation has been completed, the perforated tear line of the fan-fold paper is located in the vicinity of the image transfer position of a photoconductive drum.

In the arrangement of the electrophotographic image forming process, an exposure unit, development unit and transfer unit are disposed around the photoconductive drum, and these units operate as the photoconductive drum rotates, so that an image is transferred when the exposed portion of the photoconductive drum faces a transfer position of the fan-fold paper. Therefore, to ensure that the portion of the photoconductive drum at which the beginning of the exposure is located coincides with the position of the fan-fold paper which is spaced apart from the perforated tear line thereof by a predetermined distance (i.e., to start printing from the position of the fan-fold paper spaced apart from the perforated tear line thereof by the predetermined distance) at the start of the printing, a print start position must be adjusted by relatively moving (rotating) the photoconductive drum with respect to the fan-fold paper before the printing (transferring) is started.

Nevertheless, since the fan-fold paper is alternately folded along the perforated tear lines thereof to an opposite direction, as described above, the fan-fold paper tends to be bent in the direction it has been folded when it is fed in the printer. Thus, if the fan-fold paper tends to bend in the direction projecting toward the photoconductive drum along the perforated tear line at the transfer position of the photoconductive drum (if the fan-fold paper is bent such that the back sides thereof tend to face to each other), the perforated tear line abuts against the circumferential surface of the photoconductive drum, and thus the fan-fold paper is stained by residual toner remaining on the surface of the photoconductive drum when the photoconductive drum is relatively moved, or rotated with respect to the fan-fold paper to correspond to a print start position before the printing is started (black stripes are made along a axial direction of the photoconductive drum).

SUMMARY OF THE INVENTION

It is therefore an object of the present invention to provide an improved correction mechanism for a bent recording sheet for correcting the tendency of the recording sheet to bend and abut against the circumferential surface of the photoconductive drum, thereby preventing the recording sheet from being stained.

For the above object, according to the present invention, there is provided a correction mechanism for correcting the bending direction of a sheet to be fed therethrough, including:

means for defining a feed path of the sheet, wherein the feed path is formed in such a fashion that the feed path extends substantially in the same plane, and a portion extending perpendicular to the feeding direction of the sheet is formed to have an arc-shaped cross-section.

Optionally, the means for defining a feed path includes:

a roller member, where the rotational axis of the roller member extends perpendicularly to the feeding direction of the sheet; and a guide member arranged oppositely to the roller member with respect to the feed path of the sheet, a portion of the guide member being formed as a concave portion which extends perpandicularly to the feeding direction of the sheet, the diameter of the concave portion being equal to that of the roller member, the sheet is nipped between the roller member and said the concave portion of the guide member, whereby the sheet is caused to contact the circumferential surface of the roller member by a predetermined amount.

Further, the mechanism includes means for releasing the roller member.

Still further, the mechanism includes means for urging the roller member to contact the concave portion.

Furthermore, the roller member is arranged on the upper side of the feed path, and the roller member presses the sheet to contact the concave portion by its dead weight.

According to another aspect of the invention, there is provided a bending correction mechanism for correcting a bending direction of a recording medium which is fed therethrough to be adapted to an electrophotographic image recording apparatus having a photoconductive member. An image formed on the photoconductive member is transferred onto the recording medium. The mechanism includes:

a roller member arranged on the upstream side of the feed path of the recording medium with respect to the photoconductive member, and on the photoconductive member side with respect to a feed path of the recording medium; and a guide member arranged oppositely to the roller member with respect to the feed path of the recording medium. The recording medium is nipped between the roller member and the guide member, and the recording member is caused to contact the circumferential surface of the roller member by a predetermined amount.

Optionally, the mechanism includes means for releasing the roller member.

Further optionally, the image recording apparatus includes an openable clamshell, and the correction mechanism includes means for locking the clamshell to its closed state.

The means for locking the clamshell may be a lever member which may be displaced from a locking position to a releasing position, and vice versa wherein the lever member locks the clamshell to its closed state when the clamshell is closed and the lever member is located in the locking position. The lever member is operated to be displaced the releasing position when the clamshell is opened.

According to still another aspect of the invention, there is provided a correction mechanism for correcting the bending direction of a sheet to be fed therethrough, including:

a guide member, which guides a sheet being fed along the guide member. A concave portion is formed on the guide member, which extends perpendicularly to the feeding direction of the sheet.

Also included is a pressing member for pressing the sheet against the concave portion.

DESCRIPTION OF THE ACCOMPANYING DRAWINGS

DESCRIPTION OF THE EMBODIMENTS

Figure 1:
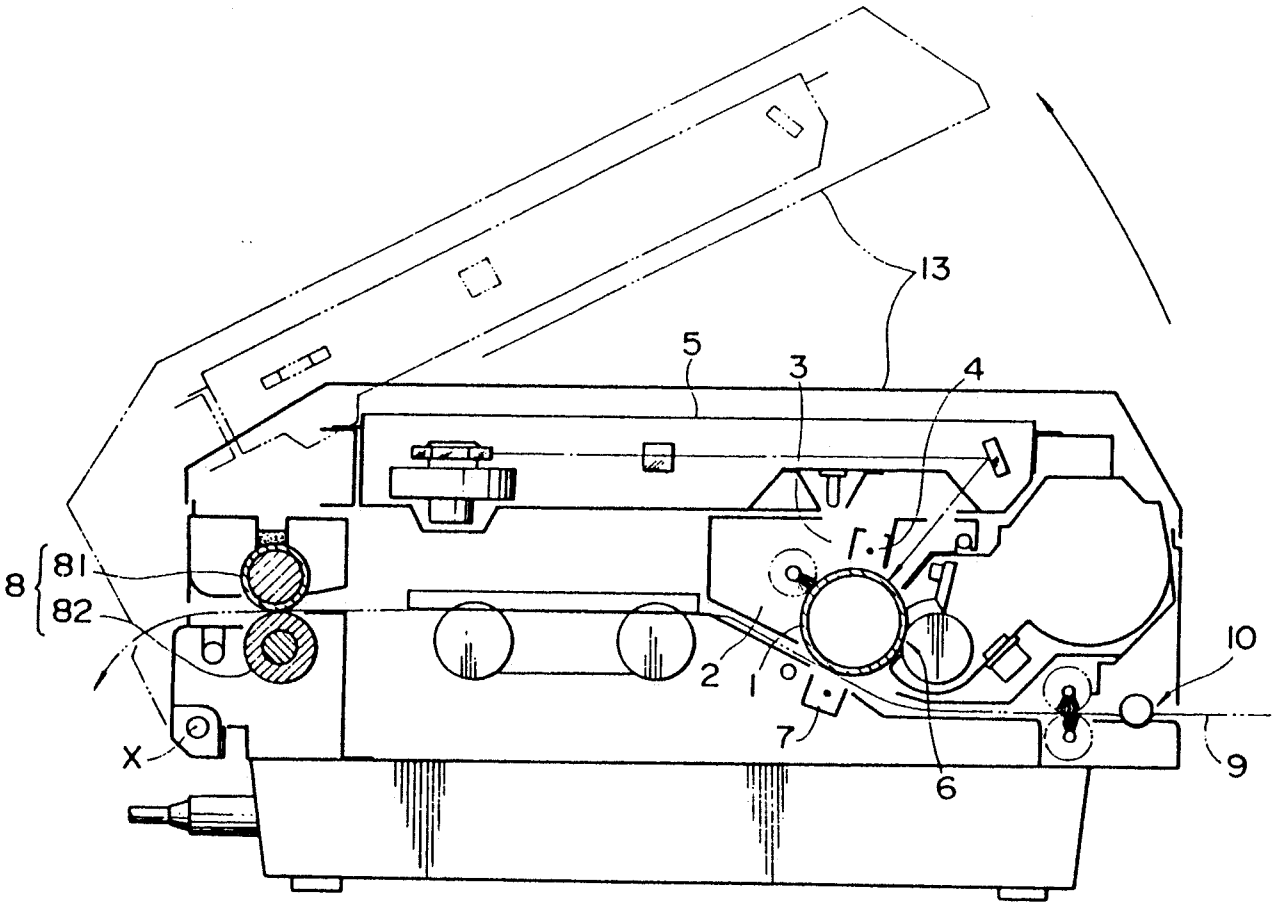
FIG. 1 is a schematic side view of an electrophotographic printer provided with a correction mechanism embodying the present invention.

FIG. 1 is a schematic side view of a laser beam printer using a fan-fold paper as a recording medium, which prints image data inputted from a computer and the like onto a fan-fold paper 9 using an electrophotographic image forming process.

Around the photoconductive drum 1 along the rotational direction thereof, a cleaning unit 2, a discharging unit 3, a charging unit 4, a scanning optical system 5 by which a laser beam modulated in accordance with the image data is introduced onto the photoconductive drum 1, development unit 6, and transfer unit 7 are disposed. A fixing unit 8 is disposed at the position on the left side in the figure to which the fan-fold paper 9 is fed. The printer comprises an openable clamshell 13 which is pivoted about an axis X.

The circumferential surface of the photoconductive drum 1 is scanned (exposed) in the axial direction thereof by a laser beam emitted from the scanning optical system 5 (main scanning), while the photoconductive drum 1 is rotated (auxiliarily scanned). Thus a two-dimensional electrostatic latent image is formed on the circumferential surface of the photoconductive drum 1. Toner is adhered to the latent image at the development unit 6 to form a toner image (development), and the toner image is transferred onto the fan-fold paper 9 at the transfer unit 7 and fixed on the fan-fold paper 9 at the fixing unit 8. Then, the fan-fold paper 9 carrying a fixed image thereon is discharged from the printer.

The fixing unit 8 is a so-called heat roller fixing unit composed of a heat roller 81 to be heated and a press roller 82 pressed thereagainst to effect a fixing action as well as a driving action to feed the fan-fold paper 9.

The fan-fold paper 9 is introduced from the right side in FIG. 1, fed to the fixing unit 8 through the transfer unit 7 and discharged to the left side in the figure.

A correction mechanism 10 according to the present invention is provided at the portion from where the fanfold paper is introduced.

Figure 2:
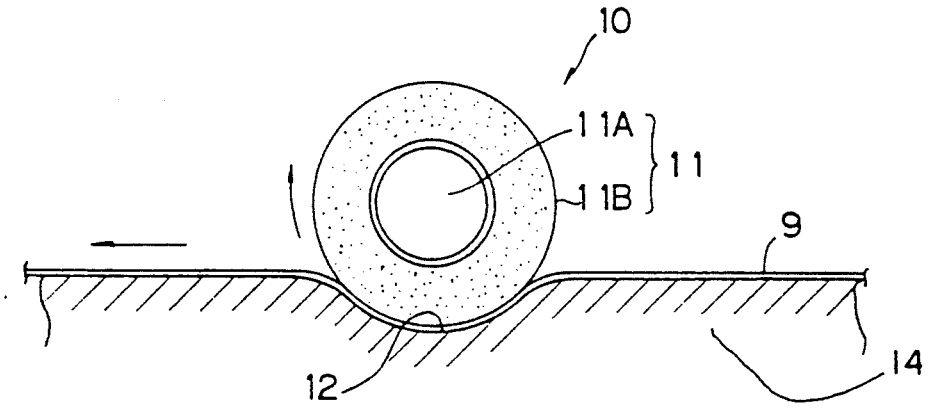
FIG. 2 is an enlarged view of the correction mechanism embodying the present invention.

As shown in FIG. 2, the fold correction mechanism 10 comprises a pressure roller 11 disposed above the paper feed path of the fan-fold paper 9 at the paper introduction portion, and a guide member 14 for defining the sheet feed path of the fan-fold paper 9 at the paper introduction portion. The fan-fold paper 9 is introduced into the printer by being guided by the guide member 14. A roller receiving portion 12 which is formed on the guide member 14 opposite to the pressure roller 11 so that the concavity of the roller receiving portion 12 corresponds to the outer diameter of the pressure roller 11. The fan-fold paper 9 is nipped between the pressure roller 11 and the roller receiving portion 12 formed on the guide member 14.

Figure 3:
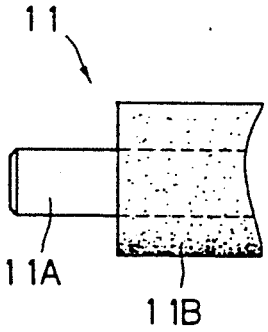
FIG. 3 is an enlarged plan view showing the end portions of a pressure roller.

As shown in FIGS. 2 and 3, the pressure roller 11 is arranged such that the outer circumference thereof is covered, except for the opposite ends of the shaft 11A, with a layer 11B made of an elastic material such as rubber or the like having a predetermined elasticity The shaft has a predetermined outer diameter and a predetermined weight. The pressure roller 11 is rotatably mounted to the frame of the laser beam printer in such a manner that the shaft 11A extending from the opposite ends of the roller 11 is fitted to the vertically elongated hole 20 (shown in FIG. 4) defined to each side plate of the frame of the laser beam printer. Thus, the shaft can be freely rotated, and vertically moved along the elongated hole 20 by a predetermined amount. The pressure roller 11 is neutrally placed (fitted on) on the roller receiving portion 12 when it is in a free state.

As described above, the roller receiving portion 12 is formed on the guide member 14 which forms the lower side of the paper feed path of the fan-fold paper 9, corresponding to the pressure roller 11 and having substantially the same radius of curvature as that of the outer circumference of the pressure roller 11. The depth of the roller receiving portion 12 with respect to the paper feed path (the uppermost surface of the guide member 14) is set such that when the pressure roller 11 is placed on the roller receiving portion 12, the fan-fold paper 9 is fed along the outer circumference of the pressure roller 11 within a predetermined angle with respect to the rotational axis of the pressure roller 11. More specifically, the fan-fold paper 9 is nipped between the pressure roller 11 and the receiving portion 12, and bent along the outer circumference of the pressure roller 11 when being fed (introduced in the printer).

With the correction mechanism 10 arranged as described above, the fan-fold paper 9 is fed along the outer circumferential surface of the pressure roller 11 and is pressed by the dead weight of the pressure roller 11 (at this time, the pressure roller 11 is rotated as the fan-fold paper 9 is fed), so that the portion (perforated tear line) of the fan-fold paper 9 bent toward the photoconductive drum (upward of the sheet feed path) is fed along the outer circumferential surface of the pressure roller 11 and thus the upwardly bent portion is reversely bent. Thus, the fan-fold paper 9 which tends to be bent upwardly with respect to the sheet feed path thereof is corrected to be flattened or reversely bent.

Incidentally, the clamshell 13 including the scanning optical system 5 of the laser beam printer can be swingably opened as aforementioned, and the fan-fold paper 9 is loaded by opening the member. The pressure roller 11 of the correction mechanism is retracted upward from the roller receiving portion 12 in association with the opening of the upper portion constituting member to facilitate the loading of the fanfold paper 9.

Figure 4:
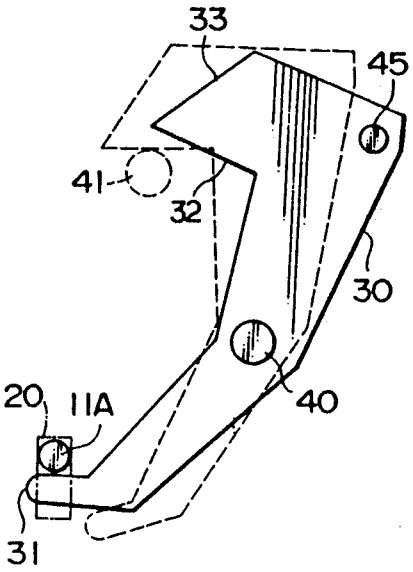
FIG. 4 illustrates the mechanism for releasing the pressure of the correction mechanism.

A locking lever 30 is provided for locking the clamshell 13 in a closed state. As shown in FIG. 4, the locking lever 30 is swingably pivoted about an axis 40 on the frame 100 of the printer (refer to FIG. 6), and an end of the locking lever 30 is extended to serve as a roller operating portion 31, located below the shaft 11A of the pressure roller 11. At the other end of the locking lever 30, formed is an L-shaped portion 32 to be engaged with a lock pin 41 fixedly arranged on an inner wall 200 of the clamshell 13 (refer to FIG. 6).

When the clamshell 13 is closed and locked, the roller operating portion 31 is spaced apart from the shaft 11A downward thereof (the pressure roller 11 is placed on the roller receiving unit 12, and thus located at the operable position for correction) as indicated in broken line in FIG. 4. While the L-shaped portion 32 of the locking lever 30 is engaged with the lock pin 41.

In order to open the clamshell 13, the locking lever 30 is rocked clockwise so as to disengage the L-shaped portion 32 from the lock pin 41 as shown by a solid line in FIG. 4. In this case, as the locking lever 30 rotates, the roller operating portion 31 abuts against the shaft 11A to lift it upward, also as shown by a solid line in the figure.

Figure 5B:
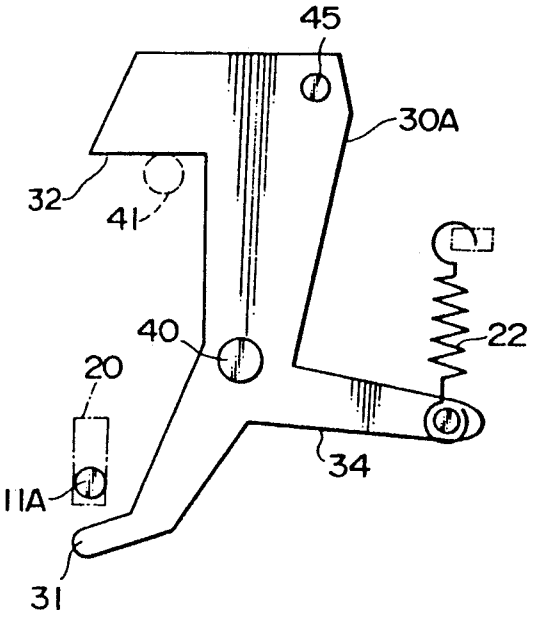
FIG. 5B shows a second modification of the mechanism for releasing the pressure of the fold correction mechanism.
Figure 5A:
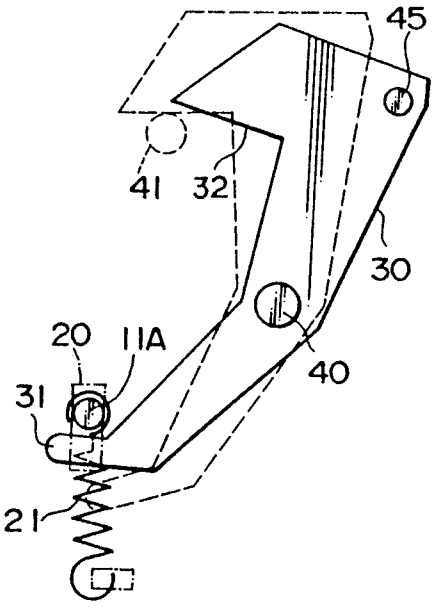
FIG. 5A shows a first modification of the mechanism for releasing the pressure of the fold correction mechanism.

FIG. 5A shows a first modified embodiment, wherein a pressure roller 11 is urged to be pressed against a roller receiving portion 12 by an urging member (spring 21). With this arrangement, the fan-fold paper 9 can be fed securely along the feed path defined by the outer surface of the pressure roller 11 and the roller receiving portion 12 under the pressure applied by the pressure roller 11 which is downwardly urged by the urging member 21.

FIG. 5B shows a second modified embodiment, wherein a protruded portion 34 is formed on the lower right hand side (in the figure) of the locking lever 30, and the end of the protruded portion 34 is urged upward by a spring 22 which is secured to the frame of the printer, not shown in FIG. 5B.

Figure 6:
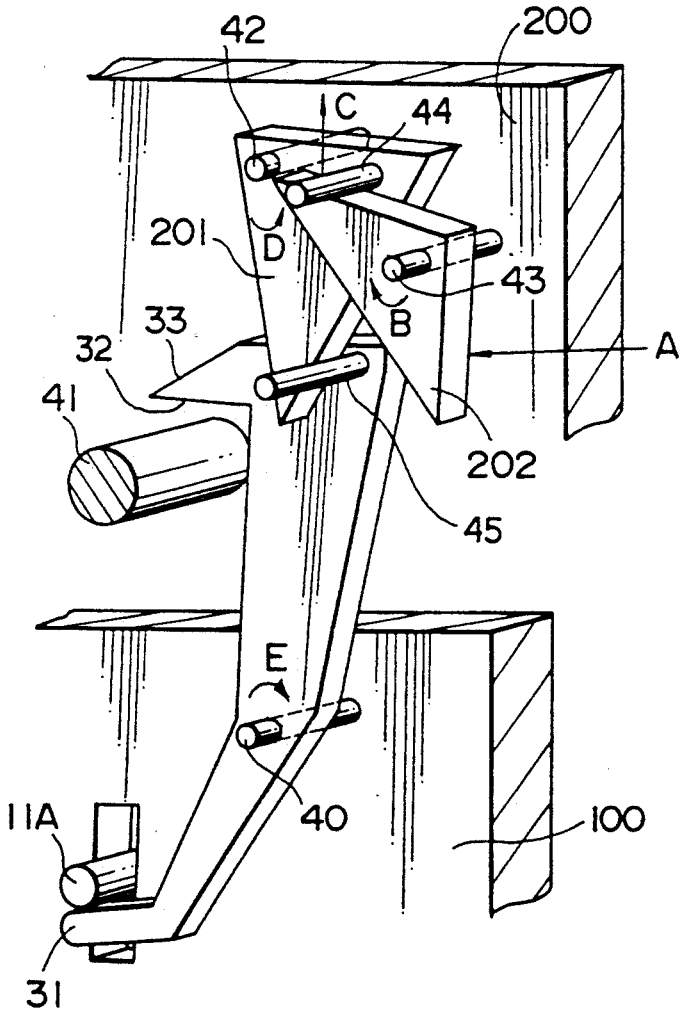
FIG. 6 is a perspective view of the mechanism for releasing the pressure of the correction mechanism of FIG. 5.

FIG. 6 is a perspective view of the release mechanism of FIG. 5. On the inner wall 200 of the clamshell 13, a pair of operating plates 201, and 202. The pair of operating plates 201, 202 are rotatably supported about the axes 42 and 43, respectively. It should be noted that the operating plates 201 and 202 are freely rotated when force is applied, and when force is removed, they stay at the position where they are located at the time that the force is removed.

As aforementioned, the locking lever 30 is swingably supported about the axis 40 on the frame 100 of the printer. The roller operating portion 31 is formed at the lower end of the locking lever 30, while L-shaped portion 32 is formed at the upper end of the lever 30. On the inner wall 200 of the clamshell 13, a lock pin 41 is provided. When the clamshell 13 is moved from its opened position to its closed position, the lock pin 41 abut against the inclined surface 33 of the locking lever 30. Then, the locking lever 30 is pushed to rotate clockwise as the lock pin 41 is moved downward. When the clamshell 13 is completely closed, the locking lever 30 rotates counterclockwise and returns to its neutral position since the shaft 11A pushes the roller operating portion 31 of the locking lever 30.

In order to open the clamshell 13, a pushing force is applied to the operating plate 202 at the right hand side of the figure as indicated by an arrow "A". The operating plate 202 is then rocked clockwise as indicated by an arrow "B". On the other operating plate 201, a pin 44 is protruded to contact the upper surface of the operating plate 202. When the operating plate 202 is rocked clockwise, the pin 44 is upwardly pushed as indicated by an arrow "C", thus the operating plate 201 rotates counterclockwise as indicted by an arrow "D". When the operating plate 201 is rocked counterclockwise, the right hand side surface of the operating plate 201 pushes a pin 45 protruded on the surface of the locking lever 30, and the locking lever 30 is rocked clockwise about the axis 40 as indicated by an arrow "E". Thus, the engagement between the L-shaped portion 32 of the locking lever 30 and the lock pin provided on the inner wall 200 of the clamshell 13 is released, and the pressure roller 11 is released from the roller receiving portion 12, simultaneously.

As described above, according to the correction mechanism according to the present invention, the continuous paper having a tendency to be bent toward the photoconductive drum with respect to the feed path at the perforated tear line thereof can be flattened or reversely bent, whereby the continuous paper is prevented from abutting against the photoconductive drum especially at the perforated tear line thereof.

As the lever for locking the clamshell is also used for means for releasing the pressure roller, the pressure roller can be positioned at its operable (mounted-on-the-receiving-portion) position whenever the clamshell is closed and locked.

The present disclosure relates to a subject matter contained in Japanese patent application No. HEI 2-125765 (filed on May 16, 1990) which is expressly incorporated herein by reference in its entirety.

What is claimed is:

1. A correction mechanism for correcting the bending direction of a fan-folded sheet being fed through an electrophotographic imaging apparatus, said apparatus having imaging means for forming an image on the sheet, comprising:

means for defining a feed path of said fan-folded sheet, said feed path having an upstream end and a downstream end, said feed path being formed in such a fashion that said feed path extends substantially in a single plane, wherein a portion of said means for defining a feed path forms an arc-shaped cross-section adjacent said upstream end; said arc-shaped cross-sectional portion extending out of said single plane and having upstream and downstream ends, said upstream and downstream ends of said arc-shaped cross-sectional portion being bordered by portions of said feed path which extend in said single plane, said means for defining a feed path being located upstream from said imaging means so as to correct the bending direction of said sheet as it enters said apparatus, wherein said means for defining a feed path comprises:

a roller member, wherein the rotational axis of said roller member extends perpendicularly to the feeding direction of said sheet; and a guide member arranged oppositely to said roller member with respect to the feed path of said sheet, a portion of said guide member forming said arc-shaped cross-sectional portion, said arc-shaped cross-sectional portion being further defined as a concave portion which extends perpendicularly to the feeding direction of said sheet, the diameter of said concave portion being equal to the diameter of said roller member, said sheet being nipped between said roller member and said concave portion of said guide member, whereby said sheet contacts the circumferential surface of said roller member by a predetermined amount.

2. The correction mechanism according to claim 1, which further comprises means for releasing said roller member.

3. The correction mechanism according to claim 1, which further comprises means for urging said roller member to contact said concave portion.

4. The correction mechanism according to claim 1, wherein said roller member is arranged on the upper side of said feed path, and wherein said roller member presses said sheet to contact said concave portion by its dead weight.

5. A bending correction mechanism for correcting a bending direction of a recording medium which is fed along a defined feed path through the mechanism and subsequently through an electrophotographic image recording apparatus having a photoconductive member positioned along said feed path, an image formed on said photoconductive member being transferred onto said recording medium, said mechanism further comprising:

means for defining a feed path substantially in a single plane along which said recording medium travels, said feed path having an upstream end and a downstream end;

a roller member arranged toward the upstream end of said feed path of said recording medium with respect to said photoconductive member, and on the photoconductive member side with respect to the feed path of said recording medium; and a guide member arranged oppositely to said roller member with respect to said feed path of said recording medium, a portion of said guide member comprising a surface which directs said recording medium substantially out of said single plane, said recording medium being nipped between said roller member and said guide surface so as to correct the bending direction of said sheet as it enters said apparatus.

6. The correction mechanism according to claim 5, which further comprises means for releasing said roller member.

7. The correction mechanism according to claim 5, wherein said image recording apparatus comprises an openable clamshell, and wherein said correction mechanism comprises means for locking said clamshell to its closed state.

8. The correction mechanism according to claim 7, wherein said means for locking said clamshell comprises a lever member which is displaceable from a locking position to a releasing position, and vice versa, wherein said lever member locks said clamshell to its closed state when the clamshell is closed and said lever member is located at said locking position, while said lever member is operated to be displaced to said releasing position when said clamshell is opened.

9. The correction mechanism according to claim 8, wherein said roller member is arranged on the upper side of said feed path of said recording medium, and wherein said roller member presses said recording medium to said guide member with its dead weight.

10. The correction mechanism according to claim 9, wherein an engaging portion is formed on said lever member, and wherein said roller member is supported such that said roller member is vertically movable by a predetermined amount, said engaging portion engaging with a shaft of said roller member and moving said roller member upward when said lever member is operated to open said clamshell.

11. The correction mechanism according to claim 8, which further comprises means for urging said roller member to contact said guide member.

12. The correction mechanism according to claim 8, which further comprises means for urging said lever member to be neutrally located at said locking position.

13. The correction mechanism according to claim 5, wherein said recording medium comprises a continuous-form recording sheet provided with perforated tear lines.

14. The correction mechanism for correcting a bending direction of a sheet according to claim 13, wherein said continuous-form recording sheet is a fan-folded sheet.

15. A correction mechanism for correcting a bending direction of a sheet to be fed along a defined feed path through said mechanism to an electrographic imaging having a means for imaging to form an image on the sheet, said mechanism comprising:

a guide member, said sheet being fed along said guide member, a concave portion being formed on said guide member, said concave portion extending perpendicularly to the feeding direction of said sheet; and a pressing member for pressing said sheet against said concave portion;

wherein said guide member and said pressing member are located upstream of the means for imaging, along said feed path, so as to correct the bending direction of said sheet as it enters said apparatus.

16. The correction mechanism for correcting a bending direction of a sheet according to claim 15, wherein said sheet is a continuous sheet.

* * * * *

UNITED STATES PATENT AND TRADEMARK OFFICE

CERTIFICATE OF CORRECTION

PATENT NO. : 5,230,691

DATED : July 27, 1993

INVENTOR(S) : Y. MONMA

It is certified that error appears in the above-identified patent and that said Letters Patent is hereby corrected as shown below:

At column 7, line 8 (claim 1, line 23) of the printed patent, delete ", wherein the rotational axis of said".

At column 7, line 9 (claim 1, line 24) of the printed patent, delete "roller member extends perpendicularly to the".

At column 7, line 10 (claim 1, line 25) of the printed patent, delete "feeding direction of said sheet".

At column 7, line 13 (claim 1, line 28) of the printed patent, delete ", a portion of said guide member forming".

At column 7, line 14 (claim 1, line 29) of the printed patent, delete "said arc-shaped cross-sectional portion, said arc-".

At column 7, line 15 (claim 1, line 30) of the printed patent, delete "shaped cross-sectional portion being further de-".

At column 7, line 16 (claim 1, line 31) of the printed patent, delete "fined as a concave portion which extends per-".

At column 7, line 17 (claim 1, line 32) of the printed patent, delete "pendicularly to the feeding direction of said".

At column 7, line 18 (claim 1, line 33) of the printed patent, delete "sheet, the diameter of said concave portion being".

At column 7, line 19 (claim 1, line 34) of the printed patent, delete "equal to the diameter of said roller member".

At column 7, line 21 (claim 1, line 36) of the printed patent, delete "said concave portion of".

At column 7, line 21 (claim 1, line 36) of the printed patent, delete "," .

At column 7, line 22 (claim 1, line 37) of the printed patent, delete "whereby said sheet contacts the circumferential".

At column 7, line 23 (claim 1, line 38) of the printed patent, delete "surface of said roller member by a predetermined".

At column 7, line 24 (claim 1, line 39) of the printed patent, delete "amount".

UNITED STATES PATENT AND TRADEMARK OFFICE

CERTIFICATE OF CORRECTION

PATENT NO. : 5,230,691

DATED : July 27, 1993

INVENTOR(S) : Y. MONMA

It is certified that error appears in the above-identified patent and that said Letters Patent is hereby corrected as shown below:

At column 8, after line 63 of the printed patent, insert --- 17. The correction mechanism according to claim 1, wherein the rotational axis of said roller member extends perpendicularly to the feeding direction of said sheet, and a portion of said guide member forms said arc-shaped cross-sectional portion, said arc-shaped cross-sectional portion being further defined as a concave portion which extends perpendicularly to the feeding direction of said sheet, the diameter of said concave portion being equal to the diameter of said roller member, whereby, said nipping of said sheet occurs between said roller member and said concave portion of said guide member, and said sheet contacts the circumferential surface of said roller member by a predetermined amount. ---.

Signed and Sealed this

Sixteenth Day of November, 1993

Bruce Lehman

*Attest:*

BRUCE LEHMAN

*Attesting Officer*

*Commissioner of Patents and Trademarks*